US006848942B1

(12) United States Patent
Regnier

(10) Patent No.: US 6,848,942 B1
(45) Date of Patent: Feb. 1, 2005

(54) CONNECTORS HAVING SUPPORTIVE BARRIER COMPONENTS

(75) Inventor: Kent E. Regnier, Lombard, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/482,135

(22) Filed: Jan. 12, 2000

(51) Int. Cl.[7] ..... H01R 13/40
(52) U.S. Cl. ..... 439/587; 439/597
(58) Field of Search ..... 439/587, 594, 439/589, 591, 66, 447, 597

(56) References Cited

U.S. PATENT DOCUMENTS

| | | | | | |
|---|---|---|---|---|---|
| 2,383,909 | A | * | 8/1945 | Buchanan | 439/695 |
| 2,903,670 | A | * | 9/1959 | Sitz | 439/552 |
| 3,703,701 | A | * | 11/1972 | Zimmerman, Jr. | 439/603 |
| 3,840,841 | A | * | 10/1974 | Clark | 439/595 |
| 3,845,452 | A | * | 10/1974 | Eifler | 439/589 |
| 4,082,398 | A | * | 4/1978 | Bourdon et al. | 439/595 |
| 4,131,331 | A | | 12/1978 | Kendall, Jr. | |
| 4,144,509 | A | * | 3/1979 | Boutros | 333/181 |
| 4,544,221 | A | * | 10/1985 | Schaller | 439/278 |
| 4,605,272 | A | * | 8/1986 | Myers et al. | 439/281 |
| 4,621,883 | A | * | 11/1986 | Noguchi | 339/60 M |
| 4,768,970 | A | * | 9/1988 | Nestor | 439/278 |
| 4,960,391 | A | * | 10/1990 | Beinhaur et al. | 439/559 |
| 5,090,919 | A | | 2/1992 | Tsuji | 439/519 |
| 5,098,311 | A | * | 3/1992 | Roath et al. | 439/290 |
| 5,098,315 | A | * | 3/1992 | Scowen | 439/587 |
| 5,188,543 | A | * | 2/1993 | Swift | 439/620 |
| 5,199,889 | A | * | 4/1993 | McDevitt, Jr. | 439/66 |
| 5,334,032 | A | * | 8/1994 | Myers et al. | 439/140 |
| 5,476,211 | A | | 12/1995 | Khandros | 228/180.5 |
| 5,496,193 | A | * | 3/1996 | Kameyama | 439/589 |
| 5,525,064 | A | | 6/1996 | Mowry | 439/66 |
| 5,531,022 | A | | 7/1996 | Beaman et al. | 29/850 |
| 5,573,435 | A | | 11/1996 | Grabbe et al. | 439/862 |
| 5,611,696 | A | | 3/1997 | Donner et al. | 439/66 |
| 5,628,636 | A | | 5/1997 | Ollivier | 439/70 |
| 5,629,837 | A | | 5/1997 | Barabi et al. | 361/767 |
| 5,647,750 | A | * | 7/1997 | Tran et al. | 439/72 |
| 5,702,256 | A | | 12/1997 | Severn | 439/71 |
| 5,713,744 | A | * | 2/1998 | Laub | 439/66 |
| 5,746,608 | A | | 5/1998 | Taylor | 439/70 |
| 5,800,184 | A | | 9/1998 | Lopergolo et al. | 439/66 |
| 5,820,389 | A | * | 10/1998 | Hashiguchi | 439/66 |
| 5,823,792 | A | | 10/1998 | Regnier | 439/66 |
| 5,864,946 | A | | 2/1999 | Eldridge et al. | 29/843 |
| 5,927,725 | A | * | 7/1999 | Tabata et al. | 277/607 |
| 5,938,451 | A | | 8/1999 | Rathburn | 439/66 |
| 5,967,800 | A | * | 10/1999 | Bishop | 439/74 |
| 6,106,305 | A | * | 8/2000 | Kozel et al. | 439/66 |
| 6,203,348 | B1 | * | 3/2001 | Fukuda | 439/275 |

* cited by examiner

*Primary Examiner*—Chandrika Prasad
(74) *Attorney, Agent, or Firm*—Robert J. Zeitler

(57) ABSTRACT

Connectors are provided which have a plurality of contacts mounted within a dielectric housing. Also mounted within the housing and in engagement with the contact is a retention member which supports the contact within the housing while also imparting a barrier to liquid flow through the housing. The contacts are formed after assembly to provide a terminal and to maintain the contact securely within the housing.

27 Claims, 3 Drawing Sheets

CONNECTORS HAVING SUPPORTIVE BARRIER COMPONENTS

BACKGROUND OF THE INVENTION

This invention generally relates to electrical connectors for miniature or microminiature contact systems. Despite their miniaturization, these connectors are manufactured in a traditional manner, while addressing a concern of solder flux wetting. A barrier member is included in each contact assembly in order to thereby prevent passage of liquids such as solder flux from one face of the connector to the opposite face of the connector.

Electronic packages having miniature and microminiature electronic components are characterized by being especially small, dense and more efficient, leading to many challenges, including those associated with physically and electrically connecting package components together. Examples of packages include chips which are characterized by having a high circuit count in a small area. Often, these dense conditions include providing an array of terminals or contacts which are closely spaced from one another and which must remain electrically insulated from one another so as to provide a plurality of discrete electrical connections, typically in an ordered, predetermined array. An example of a connector of this type is one having a land grid array of contact pads.

An approach which has been developed for manufacturing such miniature and microminiature contact systems involves electroforming using a gold wire bonding preform. In this approach, the printed circuit board component is manufactured, as is the gold wire bonding preform. The preform is attached to the board, followed by plating and electroforming the contact, requiring approximately a two hour plating process in order to plate the contact finish. This process next etches and individualizes the contact. Overall, this process includes mask placement, followed by paste placement and solder ball placement, with attendant reflow. Thereafter, removal from the panel is carried out. This technology is exemplified by U.S. Pat. No. 5,476,211 and No. 5,864,946, incorporated by reference hereinto. A characteristic of this technology is that the same is suitable for low normal force systems of about 1 gram per mil. Another characteristic of this approach is that the contacts have limited compliance, the total range being 0.015 inch, and the working range being 0.008 inch. The electrical characteristics are as follows: self-inductance of 1.78 nh, loop inductance of 2.0 nh, and impedance of 90 ohms. Systems of this type are also characterized as being expensive.

While the approach summarized in the preceding paragraph is useful in addressing miniaturization and microminiaturization of contact systems, its attendant disadvantages, especially its limited compliance and cost, reduce its desirability. Traditional contact system manufacturing approaches can be problematic when miniaturization to this degree is to be practiced. In addition to the complications which arise in manufacture and assembly of such small components, they also can be susceptible to undesired flow of liquids therethrough. For example, soldering flux can flow from a face of the grid being subjected to soldering to an opposite face of the grid which is to provide unsoldered contact functions. This latter concern is especially of interest in those applications where the connector does not experience contact wiping.

Accordingly, there is a need for miniaturized connectors which can be manufactured efficiently without proceeding with an electroforming operation, while also addressing compliance and flux wetting issues.

SUMMARY OF THE INVENTION

In accordance with the present invention, electrical connectors are provided which have a plurality of electrically conductive contacts within a dielectric housing. The electrically conductive contacts are mounted within receptacles or through holes which are arranged in a predetermined pattern so as to provide a desired number and positioning of the plurality of electrically conductive contacts. A supportive-barrier member is associated with each of the mounts of the electrically conductive contacts within the dielectric housing. The barrier member is sized, shaped, selected and positioned so as to substantially prevent passage of liquid through the assembled connector, especially with respect to passage of soldering flux through the connector and from one face to the other. The invention also includes manufacturing procedures which stamp a ganged plurality of contacts, plate them, and assemble them into a housing or housing component, in a ganged fashion, followed by forming the contacts into a selected desired final connector assembly condition.

It is accordingly a general object of the present invention to provide an improved contact system for miniature and microminiature uses which does not follow an electroforming approach.

Another object of this invention is to provide an improved contact system and process for manufacturing same using traditional manufacturing methods and while addressing undesirable flux flow.

Another object of the present invention is to provide an improved electrical connector and manufacturing process, which connector provides a high circuit count in a small area such as needed for chips for central processing units, asics uses, and other uses where electronic packages such as those incorporating land grid arrays are required in miniaturized form, which assemblies or packages provide contact retention which is compliant yet also rigid.

Another object of this invention is to provide an improved miniaturized electrical connector having a plurality of contacts associated with a retention member which provides the functions of sealing, contact stability, and low stress fit characteristics.

Another object of this invention is to provide improved electrical connectors which mount electrical contacts or terminals in a manner which reduces the likelihood of stress development and subsequent connector warpage.

Another object of the present invention is to provide electrical connectors having contacts which can be positioned in an array at selected different pitches, including those in accordance with an in-line grid pattern and an offset grid pattern, including a 1 mm grid and a 0.50 inch grid.

Another object of the invention is to provide an improved electrical connector and procedure having slip fit contact assembly and post-assembly contact forming and shaping.

These and other objects, features and advantages of the present invention will be apparent from and clearly understood through a consideration of the following detailed description.

BRIEF DESCRIPTION OF THE DRAWINGS

In the course of this description, reference will be made to the attached drawings, wherein.

DESCRIPTION OF THE PREFERRED EMBODIMENTS

The electrical connector 6*f* the present invention connects a first electronic component (not shown) to a second electronic component (not shown). As is well-known in the art, the first electronic component has an array of terminals, typically contact pad terminals, on a surface thereof, while the second electronic component has a similar array of terminals, which can be contact pads and the like, on a surface thereof A typical connector in accordance with the present invention is designed to be positioned between such electronic components and provide required electrical communication between them.

Illustrated electrical connector 21 includes a dielectric housing 22. The housing can be essentially a single piece unit, typically molded as a unitary member. Alternatively, the dielectric housing can be comprised of a series of elongated housing components or strips 23, sometimes referred to as sticks (FIGS. 5 and 6) which are assembled together within a suitable frame such as generally shown at 24 in FIG. 1.

Figure 1:
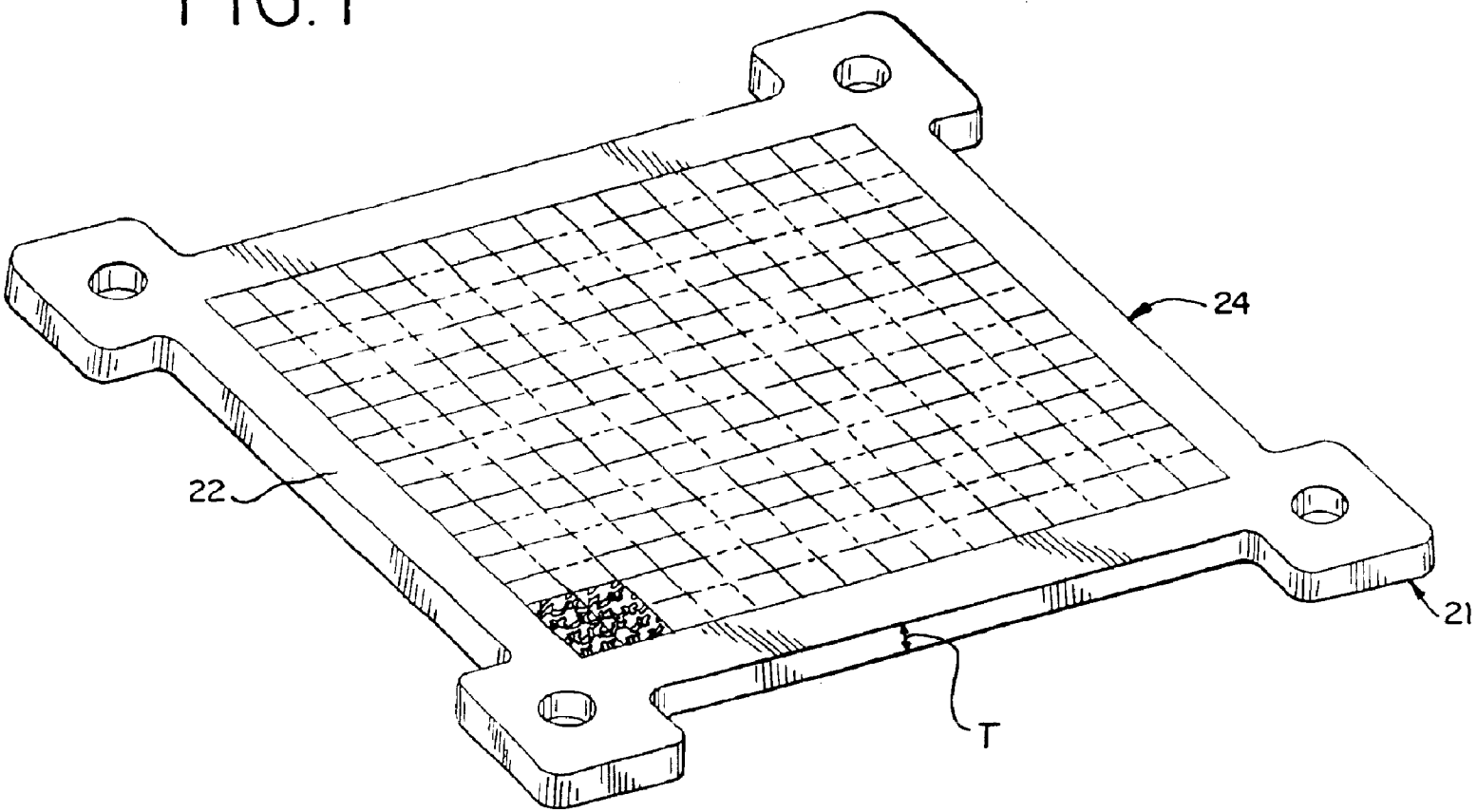
FIG. 1 is a perspective view of an example of an electrical connector incorporating an array of contact elements, a portion of which are generally shown in this view.
Figure 2:
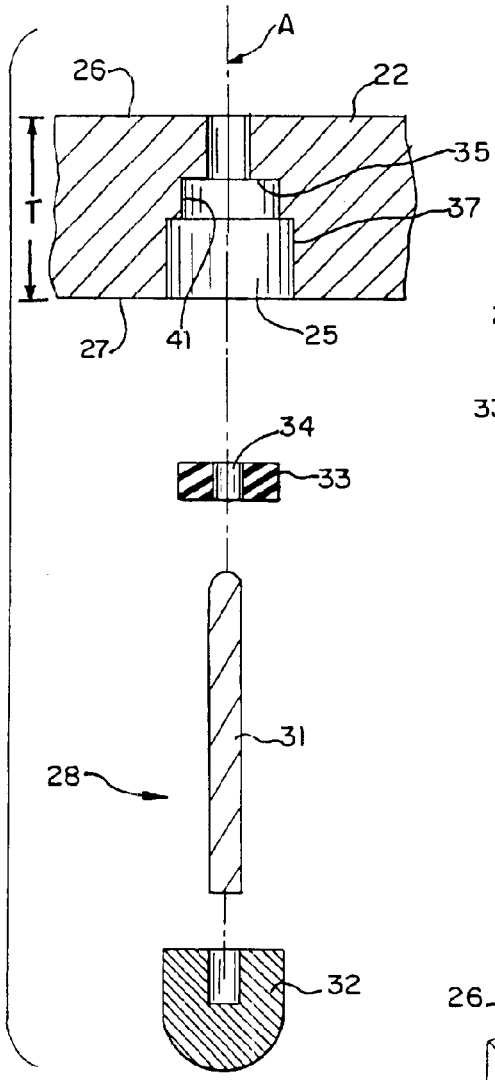
FIG. 2 is an exploded or preassembly cross-sectional view of a preferred embodiment of a contact element assembly.

However constructed, the dielectric housing has a plurality of substantially open receptacles 25 (FIG. 2). When the connector 21 is properly disposed between the electronic components, the receptacles 25 substantially align between corresponding contact pads or the like (not shown) of these components. In a typical arrangement, these two electronic components can have identically-spaced arrays of contacts or terminals, which arrays preferably correspond to the receptacles of the housing. Dielectric housing 22 has a first surface 26, shown as a top surface, and a second surface 27, shown as a bottom surface. The distance between the first surface and the second surface is the thickness T of the dielectric housing. As can be seen in the Figures, and in particular. FIGS. 1 and 2, the thickness T of the housing at the location of the receptacle 25 is generally the same as the thickness T of the housing at the location of the housing lacking receptacles 25 passing from the first surface to the second surface of the housing, in use, the top surface is positioned generally adjacent a first electronic component, and the bottom surface is positioned generally adjacent a second electronic component.

An electrically conductive contact element is disposed within at least one of the receptacles 25. An inserted, but not formed, contact element is generally designated as 28 in FIGS. 2, 3 and 4. In the illustrated embodiment, the contact 28 is an assembly of a shaft 31 and a pad 32. Electrically conductive contact element 28 alternatively can be made as a single piece member which is not-an-assembled member. In the preferred embodiment which is illustrated, the longitudinal axis of the unformed contact element 28 generally coincides with a through axis "A" of the receptacle 25. This is the as-assembled orientation.

Figure 3:
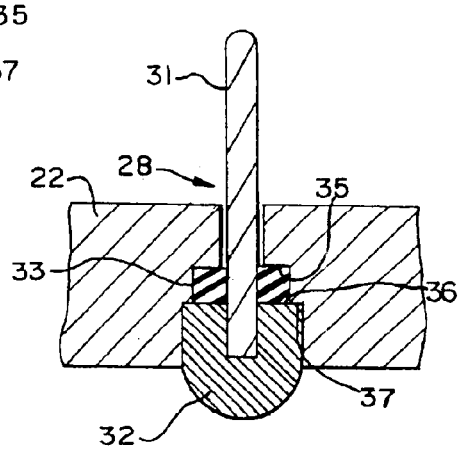
FIG. 3 is an assembled cross-sectional view of the embodiment shown in FIG. 2.
Figure 4:
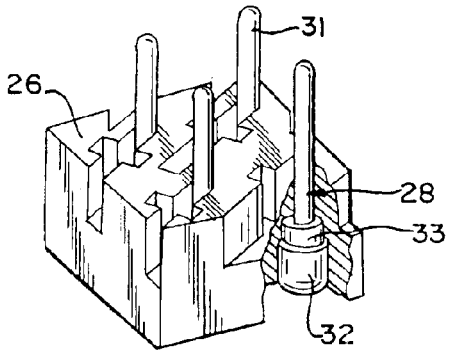
FIG. 4 is a perspective view, partially broken away, showing a plurality of the contact element assemblies as generally illustrated in FIG. 3.

With more particular reference to the assembly illustrated in FIGS. 2, 3 and 4, a retention member 33 is included. Retention member 33 is positioned within the substantially open receptacle 25 so as to be maintained therewithin after assembly and forming has been completed. This retention member also functions as a barrier to liquid passage through the receptacle 25, as more specifically described elsewhere herein.

In this illustrated embodiment, the retention member 33 has an opening 34 which receives the shaft 31 of contact element 28. Illustrated opening 34 is coaxial with through axis "A" and is of a size which cooperates with the outer surface of the shaft 31 in order to provide a force fit therebetween. It also is preferred that the external surface of retention member 33 have a force fit with respect to a portion of the substantially open receptacle 25. When these preferred force fits are provided, the retention member 33 functions as an assembly aid during the assembly procedure and as an essentially advantageous retention and barrier member after assembly and forming is completed.

In the illustrated embodiment, the receptacle 25 includes a stop surface 35. The retention member 33 is positioned between this stop surface 35 and a portion of the electrically conductive contact 28. In the illustrated embodiment, this portion of the contact is an abutment surface 36 of the pad 32. In a further preferred arrangement, the receptacle 25 has a secondary stop surface 37 which can engage another portion of abutment surface 36 of the contact pad 32. During assembly, the retention member 33 can engage temporarily this secondary stop surface 37 until proper seating is achieved between the retention member 33 and the stop surface 35.

In the illustrated embodiment, the contact element and the receptacle 25 have transverse cross sections which are substantially circular. Typically, this is the cross-section which easiest to manufacture, although other cross-sections are possible, as needed.

It will be appreciated that the close fit or force fit provided by the retention member imparts an ungapped condition to the electrical connector assembly. That is, there is a close fit and thus no gaps between the outside surface of the shaft 31 and the opening 34 of the retention member 33. Likewise, this condition exists between the outside surface of the retention member 33 and the receptacle 25. With more particular reference to this latter element of the ungapped condition, it is preferred that there be an ungapped force fit between the outside surface of the retention member 33, which is cylindrical in the illustrated embodiment, and the anterior surface 41 of the receptacle which is between the stop surface 35 and the secondary stop surface 37. It is further preferred that the thickness of the retention member 33 be such that there is an ungapped force fit of the retention member 33 between the stop surface 35 and the abutment surface 36 of the contact element 28. It is contemplated that the retention member may be oversized with respect to its nesting position within the housing receptacle and thus will be compressed somewhat in the fully assembled condition of the connector.

The function provided by the retention member 33 is facilitated by having same constructed of a generally resilient material. It can be an extruded elastomeric component. In order to withstand typical package assembly conditions, the material of the retention member is to resist 219° C. for at least 40 seconds. Materials suitable for the retention member include Viton, Neoprene, silicone rubber and the like.

Retention member 33 prevents passage of liquids such as solder flux which would be present during assembly at pads 32 and which could otherwise flow through the receptacles 25 and onto the shaft 31 at or above the first or top surface 26 of the housing 22. The retention member further supports the contact element 28 in order to thereby add stability to the contact during manufacture but especially during use. Retention member 33 provides for a low stress press fit in order to address possible warpage of the device and while also minimizing the likelihood of any bending of shafts 31 during insertion. After full assembly, the retention member 33 thus provides barrier properties while also holding the contact element compliantly and rigidly.

Figure 5:
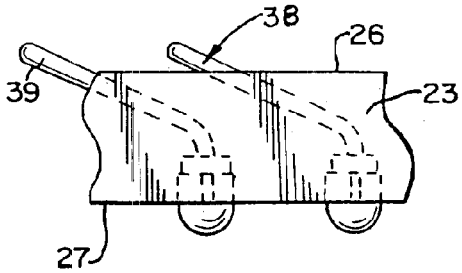
FIG. 5 is an end elevational view of an assembly generally of the type illustrated in FIG. 4, shown after the contacts have been formed.
Figure 6:
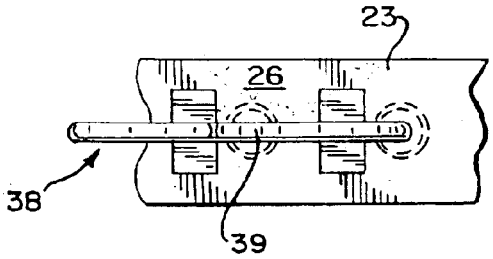
FIG. 6 is a top plan view of FIG. 5, showing an in-line grid orientation.

It will be appreciated that, in the illustrated preferred embodiment, the shaft 31 is formed after assembly into the housing. This is accomplished by bending shaft 31, to an orientation which is at an acute angle with respect to through access "A" as generally shown in FIG. 5 through FIG. 8. With the shafts 31 thus bent, the resulting formed electrically conductive contact elements 38 provide a retained contact array which can be oriented as needed. For example, it is possible to align the formed contact elements 38 according to an in-line arrangement as shown in FIG. 5 and FIG. 6. It will be noted particularly from FIG. 5 that the contacts themselves remain separated from each other by a thickness of the dielectric housing 22. This is made possible at least in part, because the open receptacles 25 need not be so large as to accommodate post-formed contact elements. Instead, because the contact elements are inserted prior to forming same, the open receptacles 25 only need accommodate the unbent or unformed contact elements 28 during insertion. An array arrangement such as shown in FIG. 5 and FIG. 6 is suitable for a grid of 0.050 inch by 0.050 inch, for example.

Figure 7:
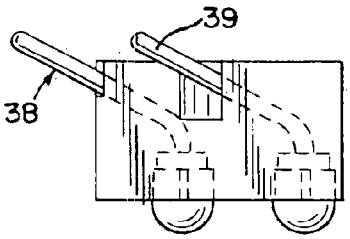
FIG. 7 is a view similar to FIG. 5, but having an offset grid orientation.
Figure 8:
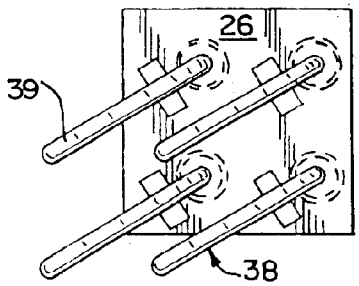
FIG. 8 is a top plan view of FIG. 7.

When an offset grid is desired, the present invention also can accommodate this alternative, as generally shown in FIG. 7 and FIG. 8. This rotated alignment also includes forming after initial assembly. No specific terminal sequence is required, and an alternative such as this can be used for a 1 mm by 1 mm grid array, for example.

Turning more specifically to the assembly procedure itself, the housing component, whether a unitary housing member or a plurality of housing strips or sticks, such are molded or otherwise fashioned out of dielectric material. These housing components provide a plurality of the substantially open receptacles 25. A plurality of the electrically conductive contact elements 28 are manufactured, typically by stamping in ganged relationship to each other. The ganged spacing is such that the longitudinal axis of each contact element will align with through axis "A" of the housing component into which it is to be assembled. In addition, a retention member 33 is positioned either within each open receptacle 25 or on the shaft 31 of each contact element.

At an appropriate time, typically before assembly, the contact elements 28 are plated or otherwise treated as needed for the intended end use. Assembly of the ganged contact elements into their respective open receptacles is carried out in order to form assemblies as shown in FIG. 3 and FIG. 4. Insertion is into the entry openings of the receptacles 25 which are through the second or bottom surface 27. At this stage, it will be noted that the assemblies can be moved without great concern that the contact elements 28 will become dislodged from their respective locations within the open receptacles 25. To the extent that any assurance is needed in this regard, the assemblies can be positioned such that the shafts 31 point downwardly, rather than upwardly as illustrated in FIG. 3.

After this assembly procedure, the forming activity is carried out. Generally, this involves bending the shafts 31 to a formed orientation, such as generally shown in FIGS. 5, 6, 7 and 8. This procedure creates the needed terminals 39 for subsequent use of the connector, while also completing the contact retention procedure.

In a typical use of the thus formed electrical connector 21, the pads 32 will be exposed to soldering conditions, which includes exposure to soldering flux. The soldering flux will tend to flow or wick into the receptacles 25, followed by subsequent passage toward the first or top surface 26 and more particularly onto the shafts 31 formed as the terminals 39. It will be appreciated that the presence of a liquid such a soldering flux on the terminals 39 will interfere with the expected electrical properties of the connector. This problem is especially of concern in those applications in which there is very little relative movement between the terminals and an opposing component which might otherwise somewhat effectively wipe the liquid from the terminals. In addition, this structure according to the invention imparts no significant loading on the housing, which is a feature of the mechanical properties of the assembly in accordance with the invention.

It will be understood that the embodiments of the present invention which have been described are illustrative of some of the applications of the principles of the present invention. Numerous modifications may be made by those skilled in the art without departing from the true spirit and scope of the invention.

What is claimed is:

1. An electrical connector, comprising:

a dielectric housing having a plurality of substantially open receptacles arranged in an array which is suitable for an electrical connector, the housing having a first surface and a second surface, the distance between the first surface and the second surface defining a thickness dimension of the housing, the thickness dimension of the housing at the location of the receptacles being generally the same as the thickness dimension of the housing at locations without receptacles, each said receptacle having a through axis;

a plurality of electrically conductive contacts positioned within at least some of said receptacles so as to provide an array of contacts arranged to be suitable for an electrical connector;

a plurality of retention members within the receptacle, at least one of said retention members engaging at least one of said contacts so as to impart an ungapped condition to the connector at the location of the retention member within the housing; and said ungapped condition of the connector substantially prevents passage of liquid through the open receptacles having said retention members therewithin.

2. The electrical connector in accordance with claim 1, wherein said retention member has an opening therethrough, and said electrically conductive contact is positioned through said retention member opening and substantially fills said opening.

3. The electrical connector in accordance with claim 2, wherein said receptacle of the housing has a stop surface within the receptacle, and wherein said retention member is between said stop surface and a portion of said electrically conductive contact.

4. The electrical connector in accordance with claim 1, wherein said electrically conductive contact has a first portion and a generally opposing second portion, a demarcation between said first and second portions of the contact being generally at said retention member, said first and second portions being at least partially within said housing, and said retention member is in contact with the respective first and second portions within the housing to thereby contribute to said ungapped condition.

5. The electrical connector according to claim 4, wherein said first portion of the electrically conductive contact generally lies along said through axis, while said second portion of the contact is at an acute angle relative to said through axis.

6. The electrical connector according to claim 1, wherein said ungapped condition imparts compliant and stable mount characteristics to said contacts.

7. The electrical connector according to claim 1, wherein said array of contacts is in a 1 mm grid.

8. The electrical connector according to claim 1, wherein said array of contacts is in a 0.05 inch grid.

9. The electrical connector according to claim 1, wherein said contact has a terminal portion is bent after insertion into said receptacle.

10. The electrical connector according to claim 9, wherein said formed terminal portion had been subjected to post-assembly bending for terminal retention.

11. The electrical connector according to claim 1, wherein said dielectric housing is a unitary member.

12. The electrical connector according to claim 1, wherein said dielectric housing includes a plurality of housing component strips.

13. The electrical connector according to claim 1, wherein said retention member has an opening therethrough, and a portion of said contact is within and in engagement with said retention member opening.

14. The electrical connector according to claim 1, wherein said retention member has an external surface which engages said receptacle.

15. The electrical connector according to claim 14, wherein said receptacle has a stop surface, and said retention member external surface abuts said stop surface.

16. The electrical connector according to claim 14, wherein said receptacle has an interior surface which is generally parallel to said through axis, and said retention member external surface abuts said receptacle interior surface.

17. The electrical connector according to claim 13, wherein said retention member has an external surface which engages said receptacle, and a force fit condition is present between said contact portion and said retention member opening and between said receptacle and said retention member external surface.

18. The electrical connector according to claim 17, wherein a force fit condition is present between said receptacle interior surface and said retention member external surface.

19. The electrical connector according to claim 1, wherein said retention member is resilient.

20. The electrical connector according to claim 19, wherein said retention member is compressed within said receptacle.

21. The electrical connector according to claim 1, wherein said contact has a land contact surface at one end thereof and a deflective terminal at an opposite end thereof.

22. An electrical connector, comprising:

a dielectric housing having a plurality of substantially open receptacles arranged in an array which is suitable for an electrical connector, the housing having a first surface and a second surface, the distance between the first surface and the second surface defining a thickness dimension of the housing, the thickness dimension of the housing at the location of the receptacles being generally the same as the thickness dimension of the housing at locations without receptacles, each said receptacle having a through axis;

a plurality of electrically conductive contacts positioned within at least some of said receptacles so as to provide an array of contacts arranged to be suitable for an electrical connector;

a plurality of retention members within the receptacle, at least one of said retention members engaging at least one of said contacts so as to impart an ungapped condition to the connector at the location of the retention member within the housing;

a retention member opening through said retention member, said electrically conductive contact being positioned through said retention member opening so as to substantially fill said opening;

said electrically conductive contact has a first portion and a generally opposing second portion, a demarcation between said first and second portions of the contact being generally at said retention member, said first and second portions being at least partially within said housing, and said retention member is in contact with the respective first and second portions within the housing to thereby contribute to said ungapped condition; and said ungapped condition of the connector substantially prevents passage of liquid through the open receptacles having said retention members therewithin and provides compliant mounting of said contact within said receptacle.

23. The electrical connector in accordance with claim 22, wherein said receptacle of the housing has a stop surface within the receptacle, and wherein said retention member is between said stop surface and a portion of said electrically conductive contact.

24. The electrical connector according to claim 22, wherein said formed terminal portion is bent after insertion into said receptacle.

25. The electrical connector according to claim 22, wherein said retention member has an external surface which engages said receptacle, said receptacle has a stop surface, and said retention member external surface abuts said stop surface, said receptacle has an interior surface which is generally parallel to said through axis, and said retention member external surface abuts said receptacle interior surface.

26. The electrical connector according to claim 22, wherein said retention member is resilient and is compressed within said receptacle.

27. The electrical connector according to claim 22, wherein said contact has a land contact surface at one end thereof and a deflective terminal at an opposite end thereof.

* * * * *